US006178867B1

(12) United States Patent
Kovac

(10) Patent No.: US 6,178,867 B1
(45) Date of Patent: Jan. 30, 2001

(54) SYNCHRONIZED TRAVEL OF INDEPENDENT ACTUATORS

(75) Inventor: Keith J. Kovac, St. Joseph, MI (US)

(73) Assignee: AlliedSignal Inc., Morristown, NJ (US)

( * ) Notice: Under 35 U.S.C. 154(b), the term of this patent shall be extended for 0 days.

(21) Appl. No.: 09/140,008

(22) Filed: Aug. 26, 1998

(51) Int. Cl.[7] ..... F15B 11/22
(52) U.S. Cl. ..... 91/171
(58) Field of Search ..... 91/171, 189

(56) References Cited

U.S. PATENT DOCUMENTS 3,850,081 * 11/1974 Joelson ..... 91/413
5,267,438 * 12/1993 Bunel et al. ..... 60/226.2
5,791,860 * 8/1998 Stockmann ..... 414/545

* cited by examiner

*Primary Examiner*—Edward K. Look
*Assistant Examiner*—Thomas E. Lazo
(74) *Attorney, Agent, or Firm*—Larry J. Palguta

(57) ABSTRACT

An arrangement for assuring synchronous motion of a pair of actuators (65, 67) includes two gear racks (99, 101) moved by cables (95, 97) fixed to remote hydraulic actuators (65, 67) to sense the motion of the actuators (65, 67). The racks (99, 101) drive pinions (111, 113) and attached bevel gears (113, 115) at identical rates and an idler bevel gear (119) that spins in-place on its own axis when actuator travel is synchronous. When the actuator (65, 67) travels are synchronous, no error signal is sent to a synchronizer servo valve (105), however, when one actuator's speed is too great, an output error signal from the idler gear (119) is sent. The output signal positions a servo valve (105) to release pressure which is holding open one of two throttling valves (107, 109). Releasing the pressure allows the throttling valve (107, 109) to be closed by a spring (129, 131) and restrict flow to the actuator (65, 67) which is traveling the fastest. A logic valve (103) which has been previously positioned by the motive flow to or from the actuators assures closure of only the correct throttling valve (107, 109) so that the speed of only the faster of the actuators is reduced. Thus the slower actuator is always assured application of full motive flow and pressure so that it can drive the system at its full rated power.

15 Claims, 3 Drawing Sheets

SYNCHRONIZED TRAVEL OF INDEPENDENT ACTUATORS

The present invention relates generally to hydraulic or pneumatic control systems and more particularly to methods and apparatus for hydro-mechanically synchronizing the operation of independent actuators or motors regardless of variations in imposed loads, travel, or actuator efficiencies. In particular, the present invention provides synchronization for the hydraulically powered movement of doors associated with aircraft engines.

It is desirable to provide a hydraulic control which assures synchronous motion of a pair of actuators. The present invention creates a hydro-mechanical means to provide reliable synchronous operation of hydraulically or pneumatically powered linear or rotary actuators or motors. It may be applied to systems in which the actuators or motors have equal or unequal displacements, efficiencies, and/or imposed loads, and may even be applied where the strokes of the actuators from stop-to-stop differ or the actuators act in differing directions. Synchronous operation is assured by means of a closed loop, mechanical feedback system and a controller which operates on the hydraulic or pneumatic motive fluid.

Some systems may require the total stop-to-stop stroke of each actuator to be different, or the orientation of each actuator to differ, yet operation to be synchronized so that each remains in step with the other at any given point in its travel range or to reach the stops simultaneously. In this scenario, a ratio other than 1 to 1 between the feedbacks from the individual actuators may be built into the differential sensor device, to provide an appropriate output error signal to the servo valve.

Another advantage inherent in the flexibility offered by the proposed approach is the availability of a number of places in which system gains can be optimized, to maximize the effectiveness of the synchronizer, and to minimize the risk of erratic behavior or unstable transient operation. For instance, over-activity of the controller in response to small travel perturbations can be restrained by inclusion of dead-band in the valving, yet quick reaction to significant synchronous operation can be assured by high gains in the throttling loops.

In certain aircraft applications, each inner door, upper or lower, is independently positioned by its own pair of hydraulically powered ram actuators. The actuators are located at either end of the door, each physically isolated from the other. A controller package manages operation of the actuators on each door. In one particular application, each inner door actuator is sized to withstand a tensile stall load of nearly 37,000 pounds and to slew against dynamic loads of 20,200 pounds. Each has a 12.5" stroke. Extreme loads, long strokes, the large physical separation between these actuators, and the light engine/airframe structure make impractical the use of a mechanical means to assure synchronization. Such a system would simply be too heavy for practical aircraft use.

The present invention provides synchronization while obviating these problems in which direction of actuator travel is detected, differential rate of motion is determined, and correction to restore synchronous operation is established by valves which use the motive flow powering the devices being driven. The valving restricts the supply of motive flow to the faster of the powered devices to limit its rate of travel. The need for the application of large braking forces at the output of the powered devices to control rate of travel is eliminated, as are the inherent heat generation and the deleterious impact on system efficiencies of braking systems. The present invention is a combination comprising: a pair of bidirectional fluid powered actuators; a source of pressurized fluid for operating the actuators; means monitoring the motion of each actuator and providing an indication of a dissimilarity between the motions of the two actuators; and means responsive to a dissimilarity indication for retarding the flow of actuating fluid from the source to the appropriate one of the actuators to diminish the dissimilarity between the motions of the two actuators.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
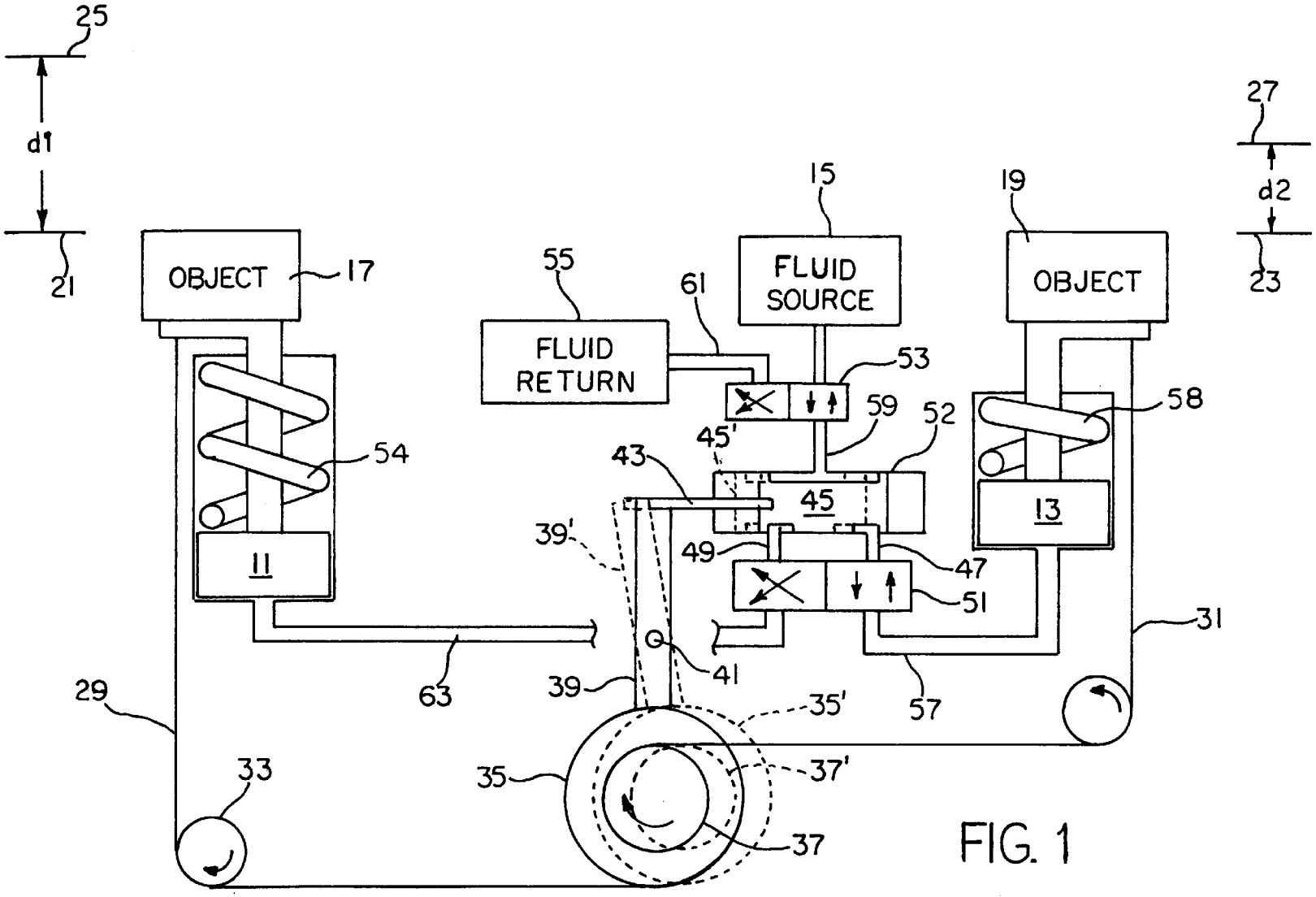
FIG. 1 is a simplified partially schematic illustration of one actuator synchronizing system according to the invention in one form.

In FIG. 1, a pair of fluid powered reciprocable pistons 11 and 13 are energized by pressurized fluid from a hydraulic or pneumatic fluid source 15 to move objects or loads 17 and 19 from initial locations 21 and 23 to final positions 25 and 27. The distance d1 which object 17 travels is greater than the distance d2 which object 19 travels. The motion of each object is monitored by a pair of cables, wire ropes, tapes or other inelastic strands 29 and 31 which are fixed at one end to the ram portion of the pistons 11 and 13 and extend by way of idler pulleys such as 31 and 33 to dissimilar radius drums 35 and 37. The drums 35 and 37 are fixed together for common rotation about a common axis. Also, the drums are preferably spring biased in a counterclockwise direction as viewed by a spiral rewind spring or other rewind tensioning arrangement (not shown). With the objects 17 and 19 in their retracted positions as illustrated, when the fluid source is enabled, fluid flows through the valves 53, 52 and 51 to extend the pistons 11 and 13. It may happen that the motion of the two objects is in perfect synchronism with piston 13 moving at a fraction $k=d2/d1$ of the speed of piston 11. Under these conditions, if the objects commence their motion at the same time, they will arrive at their destinations at the same time. That is, their motion is perfectly synchronized. If drum 35 has a radius r1 and drum 37 has a radius r2 and if $r1/r2=d1/d2$, the common rotation of the two drums will allow the cables 29 and 31 to be paid out at exactly the correct rates and the lateral forces on the two drums will be equal.

The drums 35 and 37 are fixed to a lever arm 39 which is pivotable at 41. Lever arm 39 is biased toward the neutral position shown in solid lines when the lateral forces on the two drums are equal. The opposite end of lever arm 39 is attached by way of a link 43 to the piston 45 of valve 52. If object 19 is moving too rapidly, so as to arrive at its destination 27 before object 17 arrives at its destination 25, the cable 31 will pull the drums rightwardly as toward the positions shown in dotted lines and with component positions indicated by primed reference numerals. Lever arm 39 will pivot counterclockwise and the spool or piston 45 of valve 52 will move leftwardly. This leftward spool motion diminishes or completely shuts off the fluid flow through conduit 47. Depending on the valve 52 configuration, this leftward spool motion may enhance the flow from conduit (line or fluid duct) 49, or may leave that flow unaffected. In either case, fluid flow to the piston 13 is reduced slowing the upward progress of object 19, as desired. Of course, the lever arm 39 pivots clockwise effecting a similar control when the object 17 is moving too rapidly assuring that the objects reach their destinations at the same time.

Figure 2:
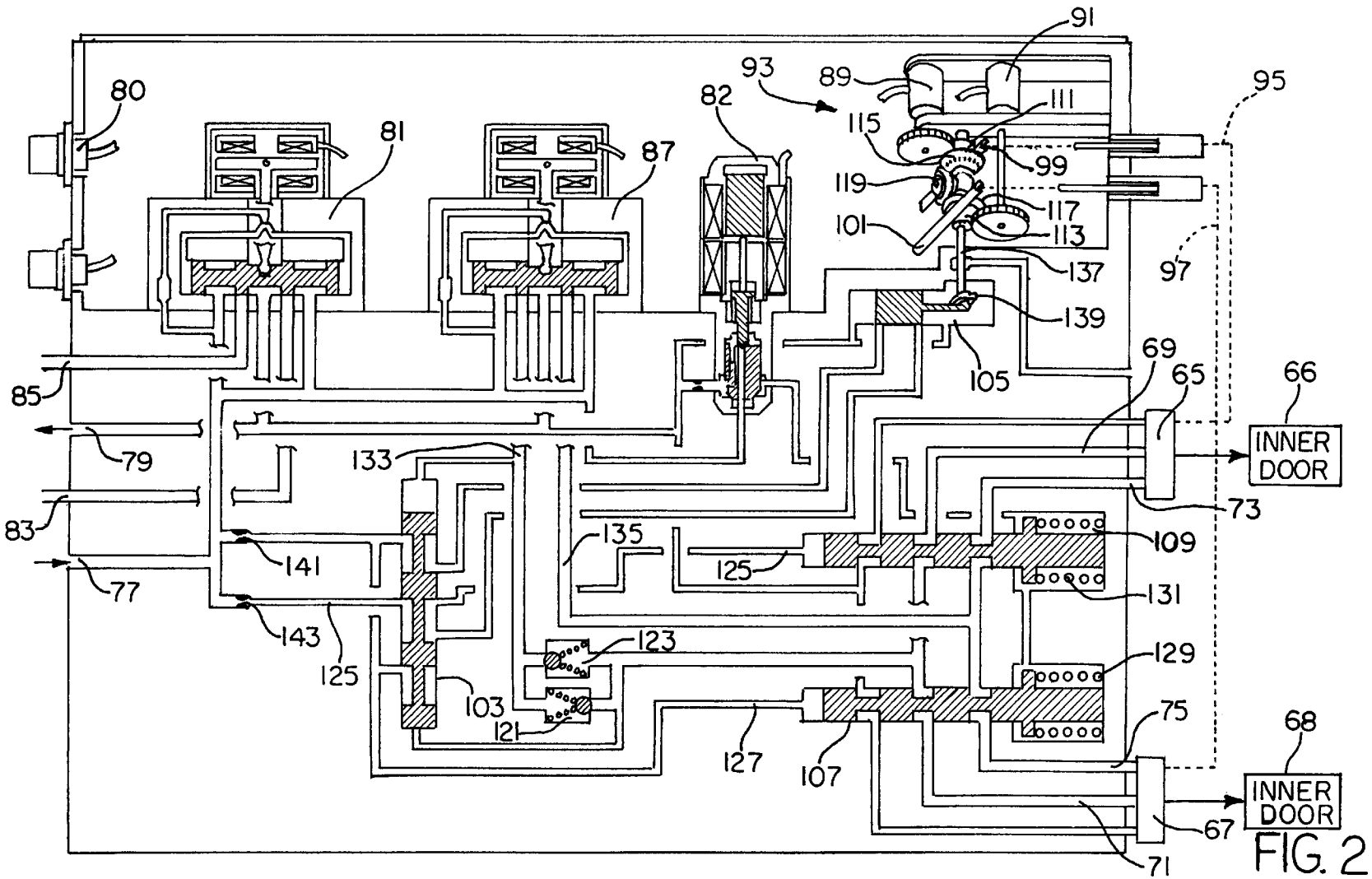
FIG. 2 is a detailed schematic of a hydraulic control valve assembly illustrating the invention in another form.

As will be the case in FIG. 2, the pistons 11 and 13 could be fluid powered to return to their initial positions, however, return springs 54 and 58 are illustrated in FIG. 1. To return the objects to their initial positions, valves 51 and 53 are actuated to interchange the fluid drain paths. Thus, the fluid from the cylinder of piston 13 flows under the urging of spring 58 through conduits 57, 49, 59, and 61 to the return 55. Similarly, fluid from the cylinder of piston 11 passes through conduits 63, 47, 59, 61 and into the return 55. Valve 51 provides a direction correction so that the proportioning valve 52 continues to properly correct for object motion imbalances.

Assume that object 17 is returning too rapidly, that is, it will arrive at the initial point 21 prior to object 19 arriving at point 23. Under this assumption, cable 29 is returning to the drum 35 too rapidly and the arm 39 again pivots counterclockwise toward the dotted line position. This motion moves piston 45 leftward restricting the conduit 47 and slowing the egress of fluid from beneath piston 11 thereby slowing the downward movement of object 17 as desired. Had valve 51 not been actuated, fluid flow from the cylinder of piston 13 would have been restricted slowing the wrong object.

Referring now to the door control valve assembly illustrated in FIG. 2, bidirectional inner door actuators 65 and 67 receive extend fluid flow from lines 69 and 71. Retract fluid flows to the actuators from lines 73 and 75. High pressure hydraulic fluid is supplied by line 77 and line 79 is a low pressure return line. Valve 81 controls the flow of pressurized fluid through line 83 to extend a pair of outer door actuators and through line 85 to retract those actuators. Electrical connections to the assembly is by connectors such as 80 and an electrical failure solenoid is illustrated at 82. The outer door 66, 68 actuators are not synchronized, however, the inner door actuators 65 and 67 are synchronized.

The actuator controller package for each door includes an inner door electro-hydraulic servo valve 87 to receive electrical signals from the engine electronic controller which provides the command to position the door, and two RVDT ("rotary variable differential transformer") position sensors 89 and 91 for feedback of door position to the engine controller. Each actuator controller package also contains a synchronizer device 93 for the inner door actuators. The synchronizer 93 receives actuator position feedback via mechanical linkages such as Bowden cables 95 and 97 and racks 99 and 101. A differential gear arrangement detects any out-of-synchronous travel between the two actuators and synchronous operation is restored by hydraulic means.

The synchronizer or synchronous differential error sensor 93 is a mechanical differential device driven by mechanical feedback linkage from the actuators. It reduces large excursions of the actuators to a small amplitude relative motion indicative of synchronicity error between the travels of the two actuators. It acts through logic 103, servo 105, and throttling 109 and 107 valves to assure that positional synchronization is maintained between the pair of actuators throughout their full travel range. This error sensor 93 is a differential gear motion sensing device and includes the pair of racks 99 and 101 each of which is coupled to and linearly movable with a corresponding one of the cables 95 and 97. There are a pair of gears 111 and 113 each engaging a corresponding rack and a pair of bevel gears 115 and 117 each coupled for joint rotation with a corresponding gear 111 or 113. A third bevel gear 119 simultaneously engages each of the pair of bevel gears 115 and 117 and revolves about its axis ultimately resulting in a retardation of the flow of actuating fluid from the source line 77 to the appropriate one of the actuators 65 or 67 only when the two cables 95 and 97 move by different amounts. In response to this out-of-synchronous actuator travel condition, the error sensor 93 positions the hydraulic synchronizer servo valve 105 in the controller. For example, if actuator 65 which is coupled to cable 95 is leading the other actuator in the extend direction, the spool in valve 105 moves leftwardly as viewed. The resultant signal from the servo valve 105 is routed through the direction detector and logic valve 103 to one of two spring loaded, pressure opened hydraulic synchronizer throttling valve 109.

The logic valve 103 is positioned by a differential pressure signal from one of the connecting hydraulic lines between the inner door valve 87 and the throttling valves 107 and 109. The pressure signal which positions the logic valve 103 is created by check valves 121 and 123 within this line. The directional check valve 123 operates (opens) when flow in the line is extending the actuators, the other check valve 121 opens when flow is retracting the actuators 65 and 67. Check valve cracking pressures are preset to achieve the desired minimum force margin to move the logic valve. Force margins and robustness as well as logic and check valve reliability may be enhanced by the logic and check valve modification shown in FIG. 3 wherein, as pictured, the logic valve 103' must move before pressure can reach the check valve 121' which only then relieves and permits flow to the actuators. The logic valve 103 determines which of the two throttle valves 107 or 109 is to be activated, depending upon whether the actuators 65 and 67 are extending or retracting, to correct an asynchronous condition. The activated throttle valve 107 or 109 then restricts the flow of fluid to or from both rod and head ends of the leading actuator of the pair. Synchronicity is quickly re-established, the servo valve 105 signal is turned off (nulled) by the error sensor 93, and the throttle valve 107 or 109 returns to the open position for unrestricted flow to the actuator.

When the engine is started, hydraulic pressure from the engine pumping system will act on the end of each throttling valve 107 or 109 by way of lines 77 and 125 or 127 and compress the valve springs 129 and 131. This opens flow passages to the head and rod ends of each actuator. When the valve 87 responds to engine commands to route pressure to and from the actuator lines 133 or 135, flow in one of the two lines is initially blocked by the directional flow check valves 121 or 123. The resulting pressure drop acts on one end of the logic valve 103 to shuttle it to the other end of its stroke. One check valve remains closed to the flow but, when pressure in this line reaches the check valve cracking pressure, the other check valve opens to permit full flow to or from the actuators. In essence, the force causing the spool of valve 103 to transition is the pressure differential across the check valve. Somewhat enhanced operation of the direction sensing logic valve 103 may be achieved with the modification of FIG. 3.

Figure 3:
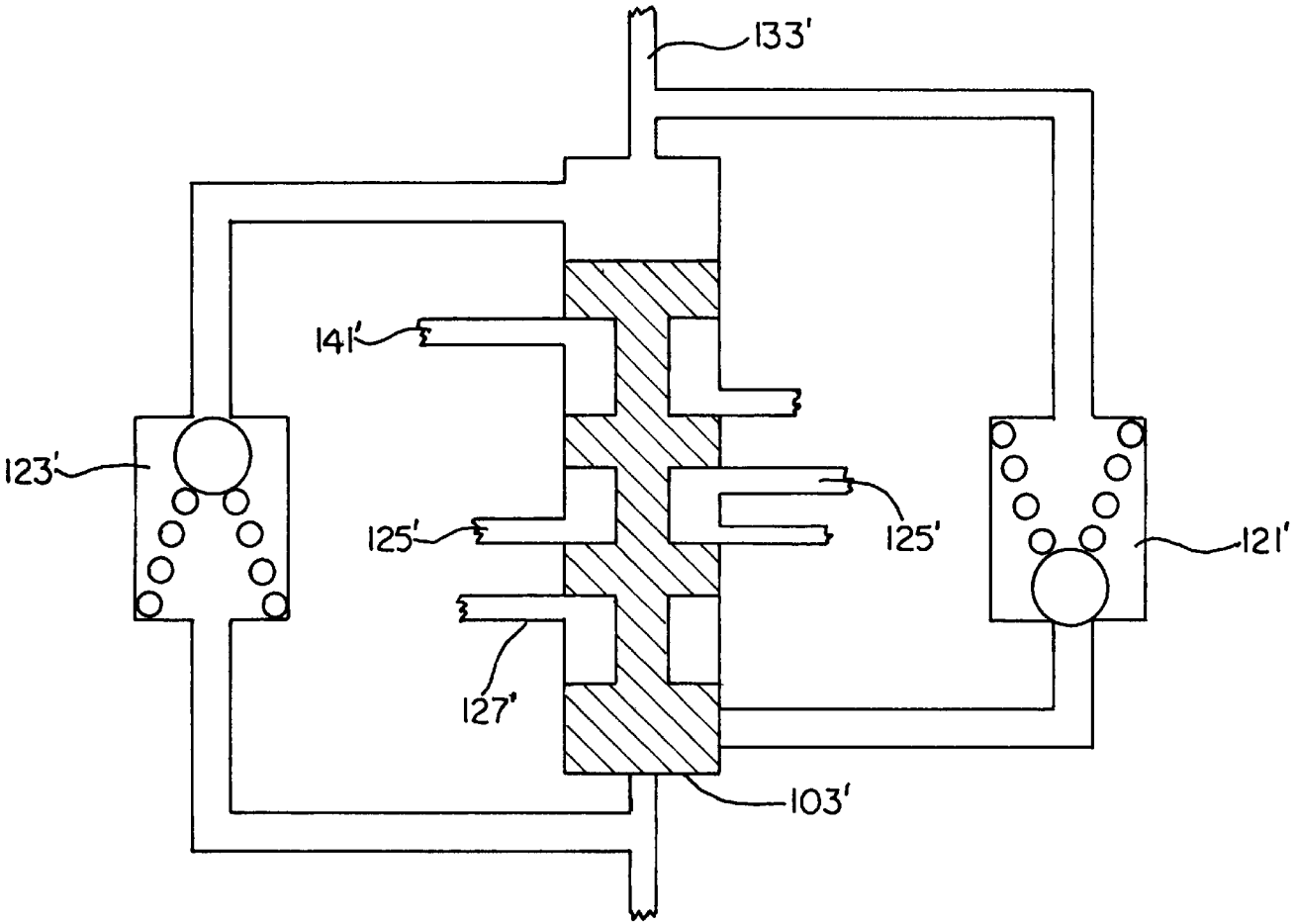
FIG. 3 is a view in cross-section of a modification to the direction detection and logic valve of FIG. 2.

In FIG. 3, primed reference numerals identify components analogous to components having unprimed reference numerals in FIG. 2. If the spool of valve 103' is in its uppermost position opposite the position shown, and extension pressure is commanded by valve 87, nearly full supply pressure will be applied by way of line 133' to the face of the spool driving it downwardly. It is only after the spool has moved some distance that the pressure driving the spool is the pressure differential across the check valve 123'. The valve 103' behaves similarly to commanded actuator retraction. The arrangement of FIG. 3 differs from FIG. 2 only in the location of the check valve connections to the valve 103'. This modification provides a strong initial impetus to the spool and a more positive or robust response by valve 103.

Returning to FIG. 2, the rate of travel of the actuators is proportional to command current to the inner door valve 87. Given identical sizing, loading, efficiencies and seal drag, the two actuators 65 and 67 will proceed toward their final positions at equivalent rates. The feedback to the controller error sensor 93 will be the same from each actuator and relative motion in all elements of the sensor is such that no position discrepancy error output is indicated. Without a load equalizing member as part of the inner door structure, however, it is unlikely that the travel rate will be identical between the actuators at the two ends of the door. The valve 87 supplies the same flow and pressure to each of the two actuators. If unequally loaded, travel rates will differ slightly and the positions of the two actuators at any point in time will tend to be out-of-sync. Whenever the actuators are out-of-sync, feedback will cause the controller synchronous differential error sensor 93 to be offset by an amount proportional to the discrepancy. As shown schematically, one rack 99 or 101 will be traveling faster and will drive its pinion 111 or 113 and attached bevel gear 115 or 117 faster than the other does. The idler bevel gear 119 will try to spin at the faster rate but is constrained by the slower rack and pinion gear set. To stay in mesh, the idler bevel gear 119 will then impart a force normal to its axis that will cause the idler gear carrier and carrier axle or rotating spider shaft 137 to rotate on the centerline between the outer bevel gears. This allows the idler 119 to advance between the outer bevel gears at a rate equal to one-half the difference in speeds of the racks and outer bevel gears, in proportion to the amount of synchronous error between the actuators. Rotation of the carrier axle 137 drives torsional movement of the synchronizer servo valve lever 139. Movement of the lever 139 offsets the synchronizer servo valve 105 from the null position to open a port which vents the hydraulic pressure from either line 125 or 127 that has been holding the throttling valves 107, 109, open.

Either actuator could be the faster (leading) actuator of the pair, and the actuators could be traveling toward either extend or retract at the time the asynchronous condition is detected. The error sensor 93 alone has insufficient intelligence to determine which actuator is leading in which direction of travel. The logic valve 103 provides this function and permits venting of hold-open pressure only from the end of the throttling valve associated with the leading actuator, through the servo valve 105, to return line 79. The logic valve 103 determines which of the two throttle valves 107 or 109 is to be activated, depending upon whether the actuators are extending or retracting, to correct an asynchronous condition. The activated throttle valve then restricts the flow of fluid to or from both rod and head ends of the leading actuator of the pair.

An orifice 141 or 143 upstream of each throttle valve in the signal line 125 or 127 restricts the supply of new fluid to the end of the activated throttle valve and pressure decays to a lower level. Below the pressure level at which throttle valve force balance is reached a spring 129 or 131 closes the throttle valve in proportion to the decrease in pressure. The valve begins to restrict both the rod and head end flows of the leading actuator and slows it till its rate and position match that of the lagging actuator. As this occurs the servo valve 105 is returned toward null by the error sensor 93, restoring signal pressure at the throttling valve and moving it open again against its spring till the valve is again hard over against the open stop in the positions illustrated.

With synchronous operation restored, the error sensor 93 and servo valve 105 will have returned to null. If unequal load conditions persist, the system will remain slightly off null, throttling flow to the lead actuator and matching the pace and position of the two actuators. The logic valve remains in its last position because only actuator synchronicity has changed, not the direction of flow to the actuators or their direction of travel.

In FIG. 1, the direction of actuator motion was determined by valve 53. To achieve proper feedback, valve 51 needed to be set to the proper (extend or retract) position. This could be achieved manually or by ganging the two valves 51 together for simultaneous reversal. In FIG. 2, the direction of actuator motion is determined by valve 87 and valve 103 automatically senses the fluid flow to the actuators and conditions itself appropriately. Reversal of the command to the valve 87 and thus flow to the actuators, shuttles the logic valve 103 to the opposite end of its stroke where it permits synchronous actuator movement to be monitored and maintained in this direction of travel. With the reversed travel, a leading actuator generates an opposite torque at the error sensor 93 and strokes the servo valve to the opposite side of null, to again throttle flow only to the leading actuator.

A variety of options is available for implementation of the invention depending upon packaging constraints and optimal performance to engine inner door subsystem requirements or other application. For instance, mechanical feedback may take the form of a linkage, an aircraft control cable set (push-pull, loop, or tensioned pull cables, or a steel tape system), or may even be a rotary system with internal actuator helical ball splines driving flexible shafting, to provide position feedback to the controller. The feedback mechanism may even be encased in the operating fluid cooling flow return or head end supply lines if desired, for cooling, ambient protection, lubrication, or simply packaging benefits. The error sensor within the controller can simply be a multi-grooved pulley arranged to move a pivoted lever in response to an synchronous actuator position as illustrated in FIG. 1, or it may be any of a variety of rack or gear driven planetary differential schemes, with an output proportional to the synchronous error to drive the servo system. The throttling valves can be located at the individual actuators, rather than in the controller package. And the controller package itself can be remotely located relative to the actuators.

These and other conceivable options make for a robust system approach to provide the greatest possible flexibility in the final design, not only for the controller and actuator packages, but also for the system to which it is applied.

What is claimed is:

1. A combination comprising:

a pair of bidirectional fluid powered actuators;

a source of pressurized fluid for operating the actuators;

means mechanically coupled to the actuators for continuously monitoring the motion of each actuator and providing an indication of a dissimilarity between operating motions of the actuators; and means responsive to a dissimilarity indication for retarding the flow of operating fluid from the source to an appropriate one of the actuators to diminish the dissimilarity between the operating motions of the two actuators.

2. The combination of claim 1, wherein the responsive means includes means for determining the direction of travel of each actuator.

3. The combination of claim 2, wherein the actuators are hydraulically powered linear actuators, each having a piston reciprocable between extended and retracted positions, the appropriate one actuator being the actuator with the greater extension when the actuators are transitioning from the retracted toward the extended position and the actuator with the lesser extension when the actuators are transitioning from the extended toward the retracted condition.

4. The combination of claim 3 wherein the extent of linear travel between the extended position and the retracted position of one actuator is a constant multiple of the extent of linear travel between the extended position and the retracted position of the other actuator and the means for monitoring includes means for reducing the monitored motion of the one actuator by a factor which is the reciprocal of the constant multiple.

5. The combination of claim 1, wherein the bidirectional fluid powered actuators are actuators operable together to open and close a door of an aircraft engine.

6. The combination of claim 1, wherein the responsive means comprises a proportioning valve for simultaneously retarding the flow of actuating fluid from the source to said one of the actuators and enhancing the flow of actuating fluid from the source to the other actuator in response to a dissimilarity indication thereby diminishing the dissimilarity between the motions of the two actuators.

7. A combination comprising:

a pair of bidirectional hydraulically powered linear actuators each having a piston reciprocable between extended and retracted positions;

a source of pressurized fluid for operating the actuators;

means monitoring the motion of each actuator and providing an indication of a dissimilarity between operating motions of the actuators, the means for monitoring including a differential gear motion sensing device and a pair of mechanical feedback members each having one end fixed to a corresponding piston for reciprocation therewith and the other end drivingly coupled to the differential gear motion sensing device; and means including means for determining the direction of travel of each actuator and responsive to a dissimilarity indication for retarding the flow of operating fluid from the source to an appropriate one of the actuators to diminish the dissimilarity between the operating motions of the actuators, the appropriate one actuator being the actuator with the greater extension when the actuators are transitioning from the retracted toward the extended position and the actuator with the lesser extension when the actuators are transitioning from the extended toward the retracted condition.

8. The combination of claim 7, the differential gear motion sensing device includes a pair of racks each coupled to and linearly movable with a corresponding cable, a pair of gears each engaging a corresponding rack, a pair of bevel gears each coupled for joint rotation with a corresponding gear, and a third bevel gear simultaneously engaging each of the pair of bevel gears, the third bevel gear turning to cause the responsive means to retard the flow of actuating fluid from the source to the appropriate one of the actuators only when the two cables move by different amounts.

9. The combination of claim 7, further comprising a pair of flow control valves each in a circuit with a corresponding actuator for restricting selectively the flow of fluid to and from the corresponding actuator, and a logic valve responsive to fluid flow to and from the actuators for enabling an appropriate one of the corresponding control valves depending on whether the actuators are moving from the retracted toward the extend positions or from the extended toward the retracted positions.

10. The combination of claim 9, wherein each flow control valve is held open against a normally closing spring bias by hydraulic pressure, the responsive means further including a synchronizer valve responsive to turning of the third bevel gear to vent hydraulic holding pressure from one of the flow control valves.

11. A combination comprising:

a pair of bidirectional fluid powered actuators;

a source of pressurized fluid for operating the actuators;

means monitoring the motion of each actuator and providing an indication of a dissimilarity between operating motions of the actuators; and means including a pair of throttling valves responsive to a dissimilarity indication for retarding the flow of operating fluid from the source to an appropriate one of the actuators to diminish the dissimilarity between the operating motions of the actuators, the throttling valves retarding the flow of actuating fluid from the source to said one actuator while leaving unchanged the flow of actuating fluid from the source to the other actuator in response to a dissimilarity indication to diminish the dissimilarity between the motions of the two actuators.

12. A method of coordinating the responses of two fluid powered actuating devices as they respond to fluid flows to move respective objects between initial and final positions to assure that both objects begin moving from their corresponding initial positions at the same time and simultaneously arrive at their corresponding final positions comprising the steps of:

simultaneously initiating the flow of fluid to the two actuating devices;

continuously monitoring the progress of the objects toward their final positions;

error sensing for a lack of synchronization between the two objects, and for an indication of which object is moving too rapidly so as to arrive at its final position before the other object arrives at its final position; and adjusting the flow of fluid to at least one of the actuating devices in response to the error sensing to cause the objects to arrive at their respective final positions more nearly simultaneously.

13. The method of claim 12 wherein the distance between the initial and final positions for one object is a constant multiple of the distance between the initial and final positions of the other object, the step of error sensing including adjusting the monitored progress of said one object by dividing by the constant multiple and directly comparing the monitored progress of the other object and the adjusted progress of said one object.

14. The method of claim 12 wherein the distances between the initial and final positions of the two objects are the same and the step of error sensing comprises determining the ratio of the speeds of the two objects, the step of adjusting including decreasing the flow of fluid to the actuating device of the more rapidly moving object.

15. The method of claim 12, wherein the fluid powered actuating devices are bidirectional hydraulically powered linear actuators and respond to fluid flows in a first sense to move respective objects from the initial to the final positions and in a second sense to move respective objects from the final back to the initial positions including the additional steps of determining the fluid flow sense and, when the fluid flow is in the second sense:

continuously monitoring the progress of the objects toward their initial positions;

continuously predicting which object will arrive at its initial position first; and adjusting the flow of fluid to at least one of the actuating devices in response to the predicting to cause the objects to arrive at their respective initial positions more nearly simultaneously.

* * * * *